United States Patent [19]

Bloys

[11] 4,224,700

[45] Sep. 30, 1980

[54] WATER CONSERVATION SHOWER

[76] Inventor: Billy G. Bloys, Rte. 1, Plainview, Tex. 79072

[21] Appl. No.: 72,619

[22] Filed: Sep. 5, 1979

[51] Int. Cl.[3] ..... A47K 3/22; E03C 1/06

[52] U.S. Cl. ..... 4/603; 128/66; 4/570; 4/616; 4/596; 4/544

[58] Field of Search ..... 4/146, 145, 154–155, 4/148, 185.5, 156, 153, 1, 147, 177, 178, 18; 128/66

[56] References Cited

U.S. PATENT DOCUMENTS

| | | | |
|---|---|---|---|
| 195,523 | 9/1877 | Morford | 4/156 |
| 204,879 | 6/1878 | Bozerian | 4/156 |
| 246,849 | 9/1881 | Williams | 4/156 |
| 553,046 | 1/1896 | Wenger | 4/156 X |
| 853,276 | 5/1907 | Viel | 4/156 |
| 950,269 | 2/1910 | Youngs | 4/156 |
| 2,033,023 | 3/1936 | Brown | 4/156 |
| 2,308,452 | 1/1943 | Ortyl | 4/155 |
| 2,814,905 | 12/1957 | Notaro | 4/148 X |
| 3,015,828 | 1/1962 | Beebe | 4/156 X |
| 3,293,664 | 12/1966 | Coons | 4/155 |
| 3,304,936 | 2/1967 | Kosta | 128/66 |
| 3,474,469 | 10/1969 | Steltz | 128/66 X |
| 3,606,618 | 9/1971 | Veech | 4/153 X |

*Primary Examiner*—Henry K. Artis

*Attorney, Agent, or Firm*—Clarence A. O'Brien; Harvey B. Jacobson

[57] ABSTRACT

A stopper structure is provided for downward removable insertion into the drain opening of a tub or shower stall and a water pump assembly is also provided including a water inlet and a water outlet with the water inlet supported relative to the stopper closely above the latter. A shower head water spray structure is also provided and the water outlet of the pump is communicated therewith. When it is desired to recirculate shower water, the conventional shower or tub water valve is operated after the stopper structure has been utilized to plug the shower or tub drain and until a sufficient quantity of water is collected in the shower or tub bottom. Thereafter, the water pump of the recirculating shower may be actuated whereupon the water collected in the bottom of the shower or tub may be pumped therefrom and outwardly from the shower head water spray structure.

8 Claims, 5 Drawing Figures

Fig. 1
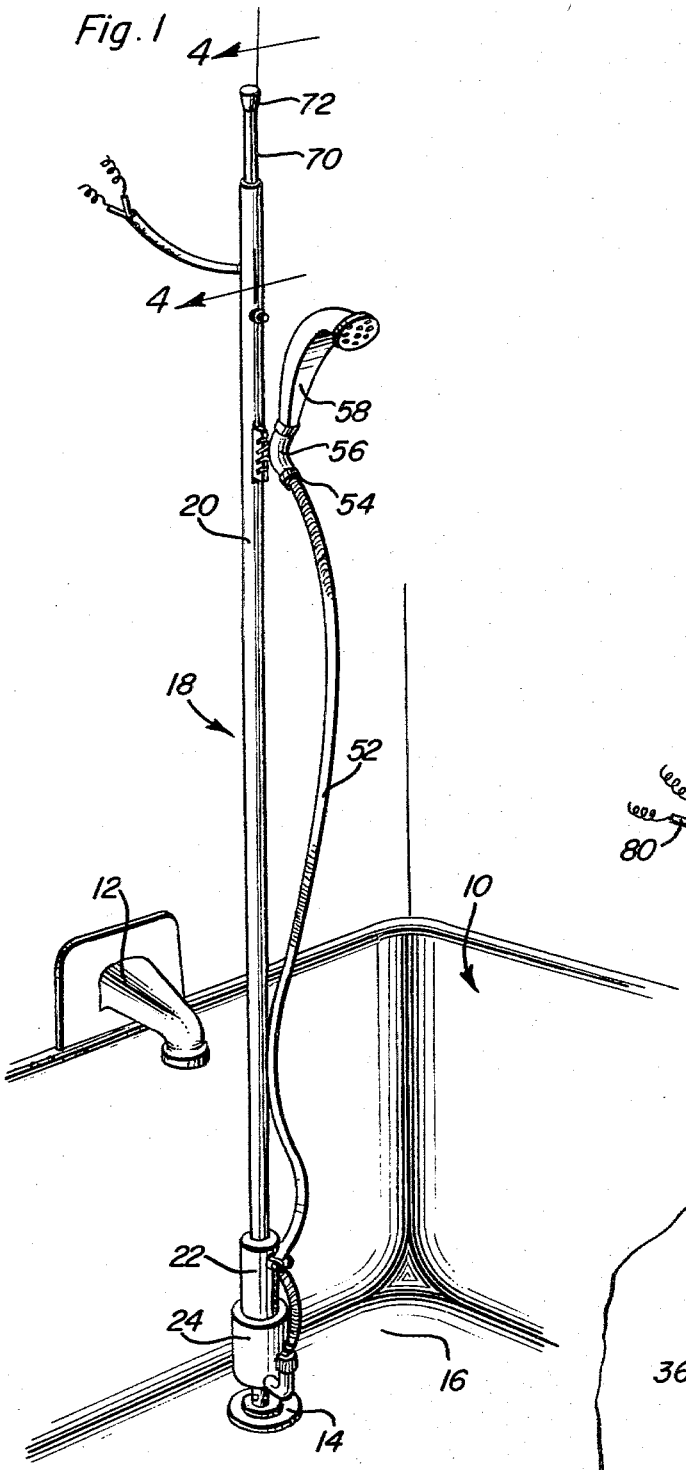
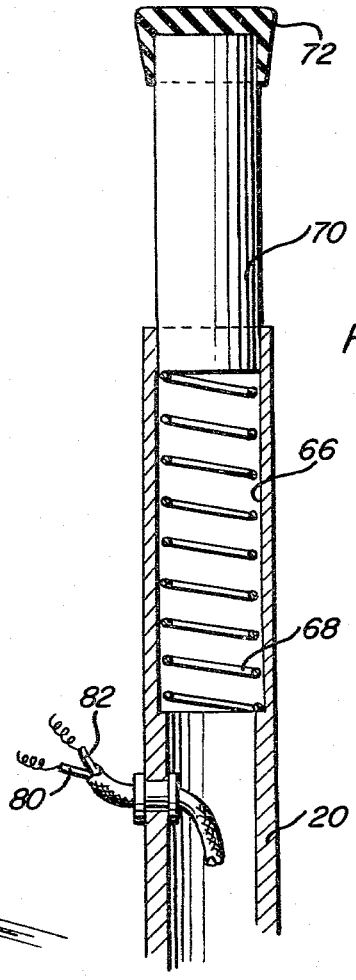
Fig. 4
Fig. 5
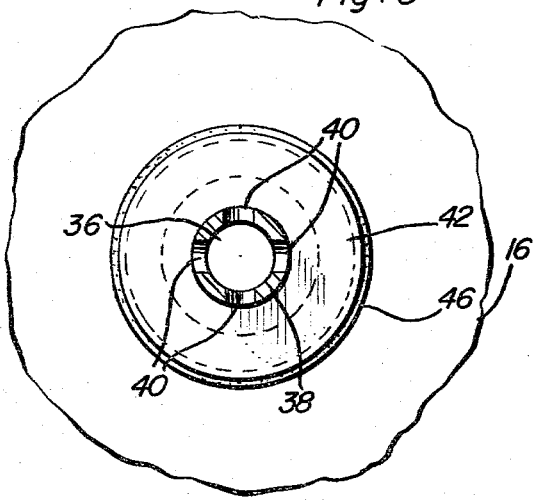

Fig. 2
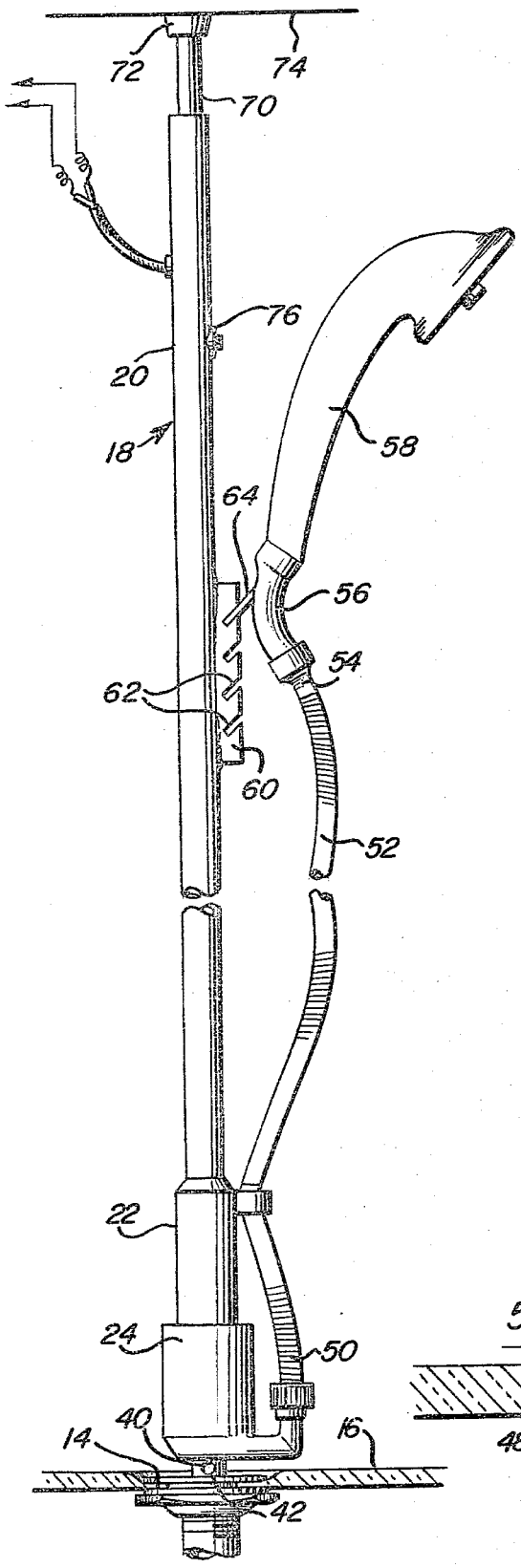
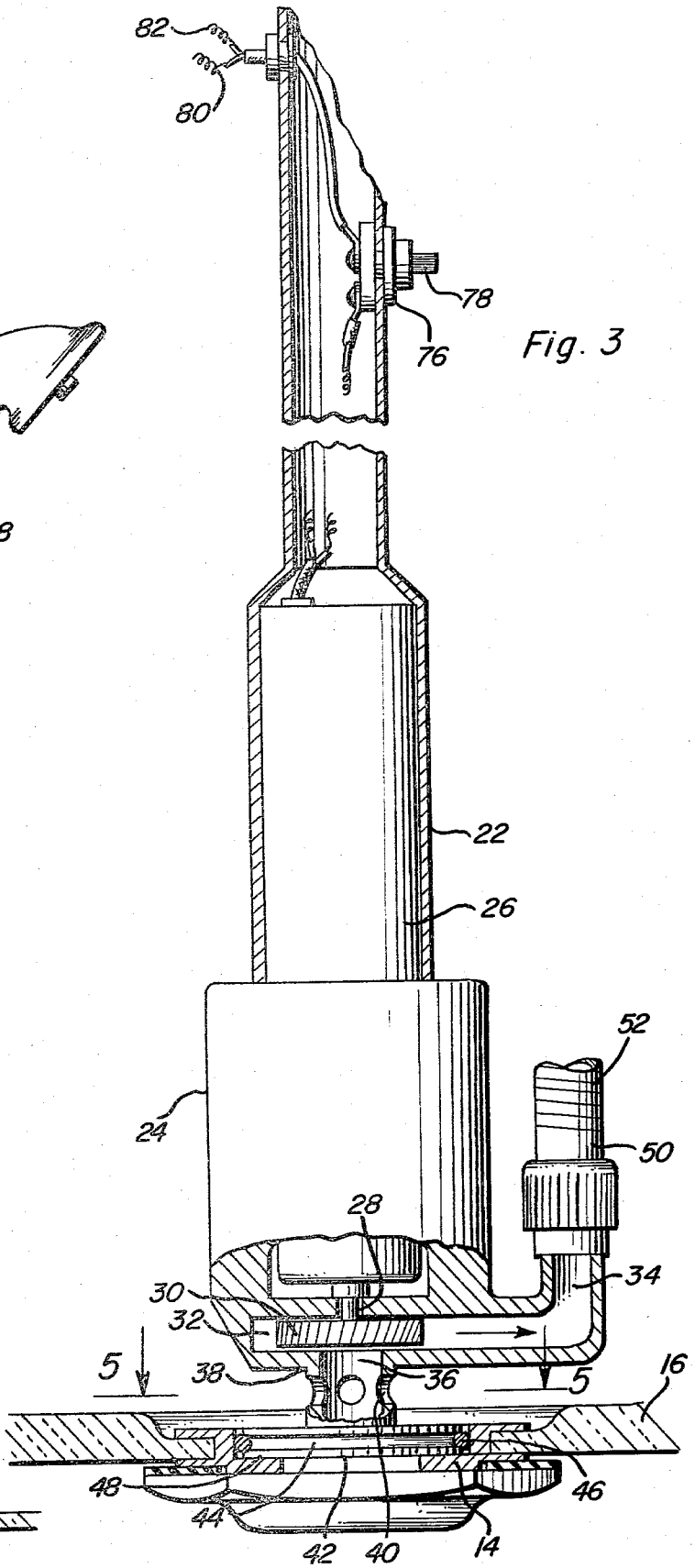
Fig. 3

WATER CONSERVATION SHOWER

BACKGROUND OF THE INVENTION

In many locales, clean water for showers and baths is not available and it becomes very expensive if a person desires to take a shower in clean water which must be purchased in one gallon or other capacity containers. In addition, in some localities, shower facilities are the exception rather the rule. Accordingly, a need exists whereby shower facilities may be provided in substantially any bathing facility and in a manner requiring only a small quantity of water.

Recirculating tub and spray baths as well as portable shower units also capable of recirculating the water utilized therein are disclosed in U.S. Pat. Nos. 853,276, 2,308,452, 2,814,905, 3,015,828 and 3,606,618. However, these previously known structures are not capable of being readily utilized in conjunction with conventional bathing facilities independent of modifications to those conventional facilities.

BRIEF DESCRIPTION OF THE INVENTION

The main object of this invention is to provide a recirculating shower which may be utilized in conjunction with conventional bathing facilities and without modifications to those conventional bathing facilities.

Yet another object of this invention is to provide a recirculating shower structure which will enable a person to enjoy a shower while using very little water.

Still another object of this invention is to provide a shower construction which will be capable of conserving considerable quantities of water if utilized in the domestic bathing facilities in this country.

Still another important object of this invention is to provide a recirculating shower which may be readily operatively associated with a tub or shower stall drain in a minimum of time and with a minimum of effort.

A final object of this invention to be specifically enumerated herein is to provide a recirculating shower in accordance with the preceding objects and which will conform to conventional forms of manufacture, be of simple construction and easy to use so as to provide a device that will be economically feasible, long lasting and relatively trouble-fee in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of a conventional tubtype bathing facility and with the recirculating shower of the instant invention operatively associated therewith;

FIG. 2 is a fragmentary enlarged vertical sectional view taken substantially upon a plane passing through the drain outlet of the bathing facility illustrated in FIG. 1;

FIG. 3 is an enlarged fragmentary transverse vertical sectional view similar to FIG. 2 and illustrating some of the internal structural components of the recirculating shower;

FIG. 4 is an enlarged fragmentary vertical sectional view taken substantially upon the plane indicated by the section line 4—4 of FIG. 1; and FIG. 5 is a fragmentary horizontal sectional view taken substantially upon the plane indicated by the section line 5—5 of FIG. 3.

DETAILED DESCRIPTION OF THE INVENTION

Referring now more specifically to the drawings, the numeral 10 generally designates a conventional form of bathing tub including a water inlet 12 and a drain fitting 14 secured through the bottom 16 of the tub 10. The inlet 12 has water supplied thereto by a conventional hot and cold water control valves (not shown) and the bathing tub 10 may also include a conventional shower head (not shown), if desired. Further, the tub 10 could well be a shower stall with the bottom 16 comprising the bottom of the shower stall and the drain fitting 14 comprising the drain for the shower stall.

The recirculating shower is referred to in general by the reference numeral 18 and includes an upright tubular standard 20 whose lower end is diametrially enlarged as at 22 and further enlarged as at 24. The enlargements 22 and 24 house an electric motor 26 and the electric motor 26 includes a rotatable output shaft 28 upon which a rotary water impeller blade 30 is mounted. The impeller blade 30 is mounted within a pump cavity 32 defined in the lower portion of the diametrically enlarged portion 24 and the pump cavity 32 includes a generally tagential outlet 34 and a downwardly opening inlet 36 defined by an upstanding tubular fitting 38 including circumferentially spaced radial inlet openings 40. The lower end of the tubular fitting 38 supports a disk-shaped stopper 42 provided with a circumferential groove 44 in which an O-ring seal 46 is seated. The drain fitting 14 may be considered as conventional and as defining a radial shoulder 48 and the stopper 42 is removably and snugly downwardly receivable within the fitting 14 and seatingly engageable against the shoulder 48. The radial openings 40 are generally horizontally aligned with the adjacent upper surfaces of the bottom 16 and, accordingly, any water collected on the bottom as a result of the drain fitting 14 being closed by the stopper 42 will have access to the interior of the fitting 38 through the openings 40.

The inlet end 50 of a flexible waterline 52 is coupled to the water outlet 34 and the outlet end 54 of the waterline 52 is removably coupled to the inlet fitting 56 of a spray head assembly 58. The upper portion of the tubular standard 20 includes a support portion 60 provided with vertically spaced inclined notches 62 and the inlet fitting 56 includes an inclined supporting lug 64 projecting therefrom which is removably selectively engageable in the notches 62 for support of the shower head assembly 58 from the upper portion of the standard 20.

The upper end of the standard 20 includes a counterbore 66 in which the lower end of a compression spring 68 is seated and an extensible elongated abutment member 70 is telescoped into the upper end of the standard 20 above the upper end of the spring 68. The upper terminal end of the abutment member 70 is provided with a resilient end piece 72 and the standard 20 may thus be supported between the drain fitting 14 and the ceiling 74 of the enclosure in which the bathing tub 10 is disposed (much in the same manner as a pole lamp is supported between the floor and the ceiling of a room).

The standard 20 further includes a control switch 76 supported therefrom including a suitable actuator 78 and the switch 76 is serially connected in one of the conductors 80 and 82 by which the motor 26 is electrically connected to a suitable source (not shown) of electrical potential. The motor 26 may be of the fully submergible type and the conductors 80 and 82 as well as the switch 76 and its actuator 78 may be suitably waterproof and adequately grounded.

In operation, the recirculating shower 18 may be supported relative to the drain fitting 14 and the ceiling 74 in the manner illustrated in FIGS. 1 and 2 of the drawings and a restrictive quantity of clean water may be placed within the bathing tub 10 so as to collect on the bottom thereof to a level at least somewhat above the level of the openings 14. Then, the electric motor 26 may be actuated whereby the water collected on the bottom 16 will be pumped upwardly though the waterline 52 and out through the shower head assembly 58. For example, two or three gallons of water may be initially utilized together with soap in order that a person taking a shower may thoroughly soap himself. Then, the motor 26 may be turned off and the lower end of the tubular standard 20 may be raised to withdraw the stopper 42 from the fitting 14 and slightly laterally displaced whereby the stopper 42 may be engaged with the upper surfaces of the bottom 16 closely alongside the fitting 14. Then, the water previously in the tub 10 may be allowed to drain therefrom. After the water has been drained therefrom, the stopper 42 may be reinserted in the fitting 14 and a quantity, perhaps two or three gallons, of clean water may be introduced into the tub 10 for the purpose of rinsing. Thus, a complete shower may be accomplished utilizing approximately six gallons of water or less.

It is to be noted that the circulating shower 18 may be utilized when only bottle water is available or it may be utilized in conjunction with conventional domestic shower and tub installations in this country as a water conservation step. An initial supply of water may be admitted into the bathing tub through the inlet 12 or an existing companion shower inlet at slow speed while the person taking a shower commences soaping himself. After the desired amount of initial water is introduced into the bathing tub and while the soaping operation is still taking place, the conventional shower inlet may be turned off and the motor 26 may be actuated to continue circulation of the water then in the tub 10 for soaping purposes. After the soaping operation has been completed, the stopper 42 may be removed from the fitting 14 in order to drain the soapy water from the tub. Then, the conventional water supply system may be utilized to discharge clean rinsing water into the tub 10 through the conventional shower outlet.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A recirculatory shower for a water sump including a generally horizontal bottom and having a drain outlet opening upwardly through the bottom an upright standard, a stopper structure carried by the lower end of said standard for downward removable reception in and plugging said drain outlet opening, the upper end of said standard including an upper end terminal for engaging a downwardly facing surface, a water pump assembly including a water inlet and a water outlet and supported from the lower end of said standard above said stopper structure with said water inlet structure spaced closely above said stopper structure, and a shower head structure for support in elevated position relative to said stopper structure and including an inlet with which said water pump outlet is communicated.

2. The combination of claim 1 wherein said stopper structure comprises a horizontal disk-shaped stopper member, an upstanding tubular fitting having its lower end supported from the upper surface of said stopper member, the lower end of said tubular fitting being closed and said tubular fitting including lateral inlet openings formed therein above said stopper member comprising said water pump inlet.

3. The combination of claim 2 wherein said upper end terminal structure includes a spring biased longitudinally extendible abutment member supported from said upper end of said standard, whereby said standard may be supported at its lower end from said stopper structure and at its upper end by abutting engagement of said abutment with a sealing structure disposed above said drain.

4. The combination of claim 3 wherein said water pump outlet opens outwardly of one side of the lower end portion of said standard at an elevation spaced above said stopper structure, an elongated flexible conduit having one end thereof communicated with said water pump outlet and the other end thereof communicated with said shower head inlet.

5. The combination of claim 4 wherein said shower head includes outwardly projecting support structure and said standard includes a vertically elongated support portion, said support structure being removably engageable with said support portion at points spaced vertically therealong.

6. An elongated upright standard including a longitudinally extendible spring biased upper end portion having an upper terminal end adapted for engagement with a ceiling structure, the lower end of said standard defining a stopper for removable downward reception in and plugging an upwardly opening drain formed in the bottom wall of a water sump, water pump structure carried by said standard and including a water inlet and a water outlet, said water inlet being disposed closely above said stopper, an alongated flexible water conduit, one end of said water conduit being communicated with said water pump outlet and the other end of said water conduit including water spray discharge means.

7. The combination of claim 6 wherein said stopper comprises a horizontal disk-shaped stopper member, an upstanding tubular fitting interposed between the lower end of said standard and said stopper and having its lower end supported from the upper surface of said stopper, the lower end of said tubular fitting being closed and said tubular fitting including lateral inlet openings formed therein above said stopper comprising said water pump inlet.

8. The combination of claim 6 wherein said water spray discharge means and said standard include coacting structure operable to releasably support said water spray discharge means from said standard at points spaced vertically therealong.

* * * * *